US006036844A

United States Patent [19]

Gupta et al.

[11] Patent Number: 6,036,844

[45] Date of Patent: Mar. 14, 2000

[54] THREE STAGE HYDROPROCESSING INCLUDING A VAPOR STAGE

[75] Inventors: Ramesh Gupta, Berkeley Heights; Henry Jung, Chatham Borough; Edward S. Ellis, Basking Ridge, all of N.J.; Gerald E. Markley, Baton Rouge, La.

[73] Assignee: Exxon Research and Engineering Co., Florham Park, N.J.

[21] Appl. No.: 09/073,413

[22] Filed: May 6, 1998

[51] Int. Cl.[7] ..... C10G 65/02

[52] U.S. Cl. ..... 208/49; 208/57; 208/58; 208/143; 208/147; 208/210

[58] Field of Search ..... 208/49, 57, 58, 208/143, 147, 210

[56] References Cited

U.S. PATENT DOCUMENTS

| | | | |
|---|---|---|---|
| 2,952,626 | 9/1960 | Kelley et al. | 208/210 |
| 4,021,330 | 5/1977 | Satchell | 208/89 |
| 4,243,519 | 1/1981 | Schorfheide | 208/210 |
| 4,801,373 | 1/1989 | Corman et al. | 208/210 |
| 5,292,428 | 3/1994 | Harrison et al. | 208/208 R |
| 5,670,116 | 9/1997 | Gupta et al. | 422/191 |
| 5,705,052 | 1/1998 | Gupta | 208/57 |
| 5,720,872 | 2/1998 | Gupta | 208/57 |

*Primary Examiner*—Walter D. Griffin
*Attorney, Agent, or Firm*—Henry E. Naylor

[57] ABSTRACT

A three stage hydroprocessing process includes two liquid and one vapor reaction stages, with a hydrogen containing vapor effluent produced in both liquid stages. The second liquid stage vapor effluent comprises part of the first liquid stage feed and the first liquid stage vapor effluent is the feed for the vapor stage. At least a portion of the hydrogen for the first liquid stage and vapor stage reactions is respectively provided by the hydrogen in the second and first liquid stage vapor effluents.

22 Claims, 3 Drawing Sheets

THREE STAGE HYDROPROCESSING INCLUDING A VAPOR STAGE

BACKGROUND OF THE DISCLOSURE

1. Field of the Invention

The present invention relates to hydroprocessing hydrocarbonaceous feeds using two liquid and one vapor hydroprocessing reaction stages. More particularly the invention relates to catalytically hydroprocessing a hydrocarbonaceous feed in two liquid reaction stages with liquid and vapor separation after each stage and one vapor reaction stage, in which both liquid stages produce an effluent comprising a liquid and a hydrogen-containing vapor, with the hydrogen-containing first liquid stage vapor effluent hydroprocessed in the vapor stage using the hydrogen in the vapor and the second liquid stage vapor effluent providing the hydrogen for the first stage. Most of the hydroprocessing is achieved in the first stage, with the first stage liquid effluent comprising the second stage feed, and with fresh hydrogen used in the second stage to produce a hydroprocessed product.

2. Background of the Invention

As supplies of lighter and cleaner feeds dwindle, the petroleum industry will need to rely more heavily on relatively high boiling feeds derived from such materials as coal, tar sands, shale oil, and heavy crudes, all of which typically contain significantly more undesirable components, especially from an environmental point of view. These components include halides, metals, unsaturates and heteroatoms such as sulfur, nitrogen, and oxygen. Furthermore, due to environmental concerns, specifications for fuels, lubricants, and chemical products, with respect to such undesirable components, are continually becoming tighter. Consequently, such feeds and product streams require more upgrading in order to reduce the content of such undesirable components and this increases the cost of the finished products.

In a hydroprocessing process, at least a portion of the heteroatom compounds are removed, the molecular structure of the feed is changed, or both occur by reacting the feed with hydrogen in the presence of a suitable hydroprocessing catalyst. Hydroprocessing includes hydrogenation, hydrocracking, hydrotreating, hydroisomerization and hydrodewaxing, and therefore plays an important role in upgrading petroleum streams to meet more stringent quality requirements. For example, there is an increasing demand for improved heteroatom removal, aromatic saturation and boiling point reduction. In order to achieve these goals more economically, various process configurations have been developed, including the use of multiple hydroprocessing stages as is disclosed, for example, in European patent publication 0 553 920 A1 and U.S. Pat. Nos. 2,952,626; 4,021,330; 4,243,519; 4,801,373 and 5,292,428.

SUMMARY OF THE INVENTION

The invention relates to a three stage process for hydroprocessing a hydrocarbonaceous feed in which the feed is reacted with hydrogen in the presence of a hydroprocessing catalyst in two separate, liquid reaction stages to produce a hydroprocessed hydrocarbonaceous product liquid and hydrocarbonaceous vapors containing unreacted hydrogen, with vapor and liquid separation after each liquid stage, wherein the vapors from the first liquid reaction stage are hydroprocessed by reacting with hydrogen in a vapor reaction stage and wherein the hydrogen in the vapor effluents is used for the hydroprocessing. A mixture of the hydrocarbonaceous feed to be hydroprocessed and the hydrogen containing second stage vapor effluent comprises the first stage feed, with the partially hydroprocessed first stage liquid effluent and fresh hydrogen being the feed to the second stage. The first stage vapor effluent containing unreacted hydrogen is passed into the vapor stage in which it is hydroprocessed with the hydrogen in the vapor. The hydroprocessed vapor may be cooled to recover a portion (e.g., $C_{4+}$–$C_{5+}$material) as liquid which may be blended into the second stage product liquid. Sufficient fresh hydrogen in the form of either hydrogen or a hydrogen-containing treat gas is introduced into the second stage to insure that the hydrocarbonaceous vapor effluents from the second and first liquid stages contain sufficient hydrogen (unreacted hydrogen) to provide at least a portion or all of the hydrogen required for the first liquid stage and the vapor stage hydroprocessing. The term "hydrogen" as used herein refers to hydrogen gas. More particularly the invention comprises a hydroprocessing process which includes two liquid and one vapor reaction stages and which comprises the steps of:

(a) reacting a hydrocarbonaceous feed comprising a mixture of liquid and vapor with hydrogen in a first hydroprocessing liquid reaction stage in the presence of a hydroprocessing catalyst to form a first stage effluent comprising a partially hydroprocessed hydrocarbonaceous liquid and a hydrogen-containing hydrocarbonaceous vapor, wherein said feed vapor comprises hydrogen-containing second stage hydrocarbonaceous vapor effluent which provides at least a portion of said hydrogen for said first stage reaction and for said vapor reaction stage and wherein said first stage vapor effluent contains unreacted hydrogen;

(b) separating said first stage liquid and vapor effluent;

(c) reacting said first stage liquid effluent with hydrogen in the presence of a hydroprocessing catalyst in said second hydroprocessing liquid reaction stage to produce a second stage effluent comprising a hydroprocessed hydrocarbonaceous product liquid and vapor, wherein said vapor contains unreacted hydrogen and wherein said second stage reaction hydrogen is provided by fresh hydrogen;

(d) separating said second stage liquid and vapor effluent and recovering said hydroprocessed product liquid, and (e) reacting said hydrogen-containing first stage vapor effluent with hydrogen in said vapor in the presence of a hydroprocessing catalyst in said vapor reaction stage to form a hydroprocessed hydrocarbonaceous vapor, wherein at least a portion of said hydrogen for said reaction is provided by hydrogen in said first stage vapor effluent.

The hydroprocessed vapor may then be cooled to condense out the higher boiling hydroprocessed material as liquid which may then be separated from gaseous contaminants and lower boiling material by simple separation means, such as a drum separator.

The three reaction stages may be in a single reaction vessel or in two or three separate vessels. The catalyst used in each stage may be the same or different, depending on the feed and the process objectives. Further embodiments include stripping the recovered hydroprocessed product to remove undesirable reaction products, condensing the hydroprocessed vapors and stripping the resulting condensate and, optionally, combining the condensate with the hydroprocessed product liquid. The condensate comprises the lighter or lower boiling feed fraction. While in many cases is preferred that the second stage vapor effluent contain all of the hydrogen required for the first liquid stage hydroprocessing reaction and that the first liquid stage vapor effluent contain all of the hydrogen required for the vapor phase hydroprocessing reaction, this is not always possible. Therefore, in some cases fresh hydrogen or a hydrogen-containing treat gas may also be passed into either or both the first liquid stage and the vapor stage.

In the practice of the invention, the fresh hydrocarbonaceous feed fed into the first stage reaction zone is mostly liquid and typically completely liquid. During the hydroprocessing, at least a portion of the lighter or lower boiling feed components are vaporized in each liquid stage. The amount of feed vaporization will depend on the nature of the feed and the temperature and pressure in the reaction stages and may range between about 5–80 wt. %. Thus, by liquid reaction stage is meant that some of the feed being hydroprocessed is in the liquid stage. In most cases the hydrocarbonaceous feed will comprise hydrocarbons. In an embodiment in which the process is a hydrotreating process for a sulfur and nitrogen containing distillate or diesel fuel fraction, the hydroprocessing forms $H_2S$ and $NH_3$, some of which is dissolved in the hydroprocessed product liquid and vapor condensate. Simple stripping removes these species from these liquids.

DETAILED DESCRIPTION

Figure 1:
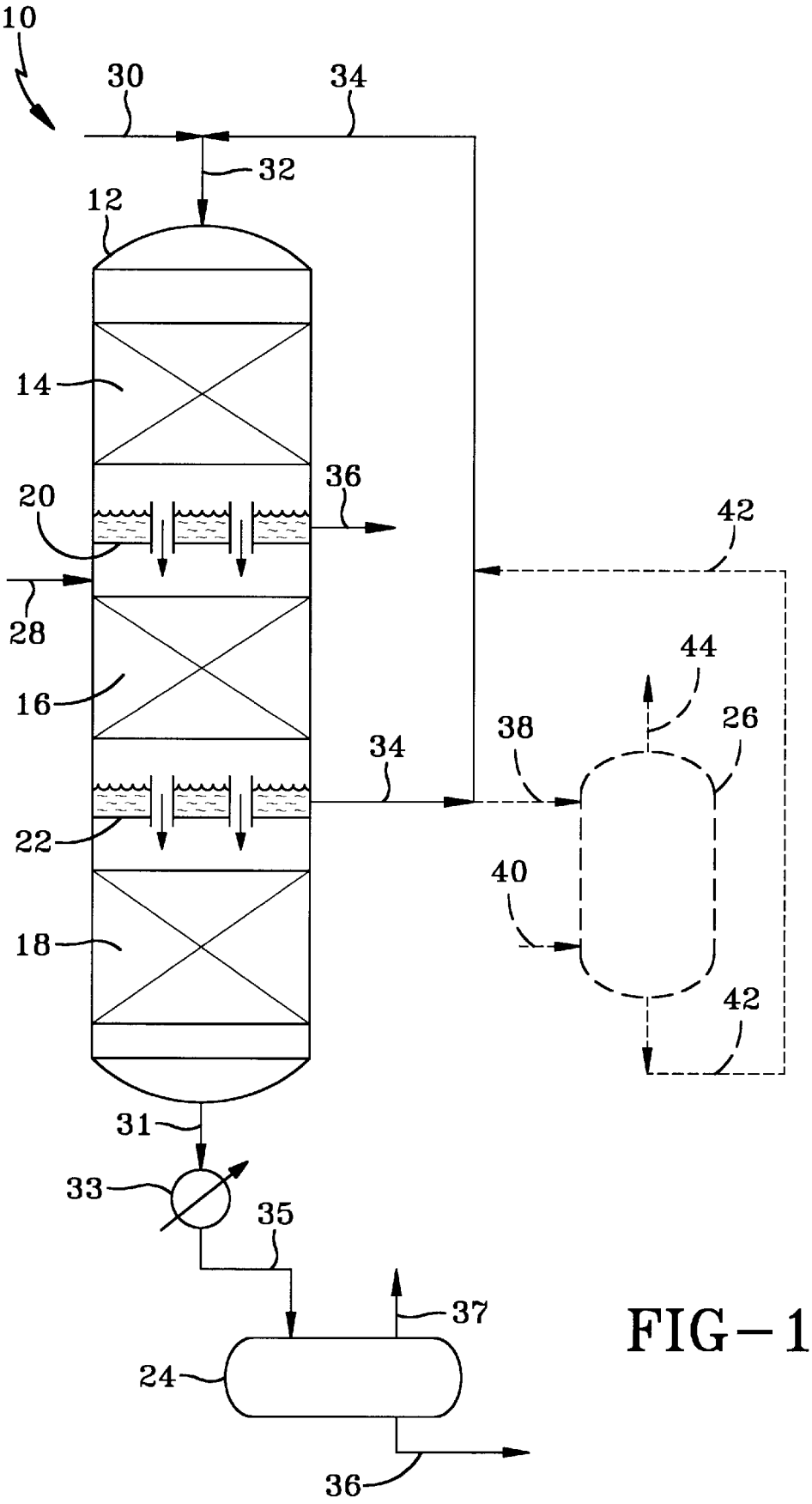
FIG. 1 schematically illustrates an embodiment of the invention with two liquid and one vapor hydroprocessing stages in a single reaction vessel.

By hydroprocessing is meant a process in which hydrogen reacts with a hydrocarbonaceous feed to remove one or more heteroatom impurities such as sulfur, nitrogen, and oxygen, to change or convert the molecular structure of at least a portion of the feed, or both. Non-limiting examples of hydroprocessing processes which can be practiced by the present invention include forming lower boiling fractions from light and heavy feeds by hydrocracking; hydrogenating aromatics and other unsaturates; hydroisomerization and/or catalytic dewaxing of waxes and waxy feeds, and demetallation of heavy streams. Ring-opening, particularly of naphthenic rings, can also be considered a hydroprocessing process. By hydrocarbonaceous feed is meant a primarily hydrocarbon material obtained or derived from crude petroleum oil, from tar sands, from coal liquefaction, shale oil and hydrocarbon synthesis. The reaction stages used in the practice of the present invention are operated at suitable temperatures and pressures for the desired reaction. For example, typical hydroprocessing temperatures will range from about 40° C. to about 450° C. at pressures from about 50 psig to about 3,000 psig, preferably 50 to 2,500 psig.

Feeds suitable for use in such systems include those ranging from the naphtha boiling range to heavy feeds, such as gas oils and resids. Non-limiting examples of such feeds which can be used in the practice of the present invention include vacuum resid, atmospheric resid, vacuum gas oil (VGO), atmospheric gas oil (AGO), heavy atmospheric gas oil (HAGO), steam cracked gas oil (SCGO), deasphalted oil (DAO), light cat cycle oil (LCCO), natural and synthetic feeds derived from tar sands, shale oil, coal liquefaction and hydrocarbons synthesized from a mixture of $H_2$ and CO via a Fischer-Tropsch type of hydrocarbon synthesis.

For purposes of hydroprocessing and in the context of the invention, the terms "fresh hydrogen" and "hydrogen-containing treat gas" are synonymous and may be either pure hydrogen or a hydrogen-containing treat gas which is a treat gas stream containing hydrogen in an amount at least sufficient for the intended reaction plus other gas or gasses (e.g., nitrogen and light hydrocarbons such as methane) which will not adversely interfere with or affect either the reactions or the products. These terms exclude recycled vapor effluent from another stage which has not been processed to remove contaminants and at least a portion of any hydrocarbonaceous vapors present. They are meant to include either hydrogen or a hydrogen-containing gas from any convenient source, including the hydrogen-containing gas comprising unreacted hydrogen recovered from hydroprocessed vapor effluent, after first removing at least a portion and preferably most of the hydrocarbons (e.g., $C_{4+}$–$C_{5+}$) or hydrocarbonaceous material and any contaminants (e.g., $H_2S$ and $NH_3$) from the vapor, to produce a clean, hydrogen rich treat gas. The treat gas stream introduced into a reaction stage will preferably contain at least about 50 vol. %, more preferably at least about 75 vol. % hydrogen. In operations in which unreacted hydrogen in the vapor effluent of any particular stage is used for hydroprocessing in a subsequent stage or stages, there must be sufficient hydrogen present in the fresh treat gas introduced into that stage for the vapor effluent of that stage to contain sufficient hydrogen for the subsequent stage or stages.

The invention can be further understood with reference to FIG. 1 which is a schematic drawing of a hydroprocessing unit useful in the practice of the invention. In this particular embodiment the hydroprocessing process is a hydrotreating process and the reaction stages hydrotreating stages. For the sake of simplicity, not all process reaction vessel internals, valves, pumps, heat transfer devices etc. are shown. Referring to FIG. 1, a hydrotreating unit 10 comprises a reaction vessel 12, a heat exchanger 33, a simple drum type of gas-liquid separator 24 and, optionally, a stripper 26 for interstage stripping shown in phantom. Vessel 12 contains three reaction stages or zones 14, 16, and 18, each comprising a fixed bed of hydrotreating catalyst and each having respective downstream gas-liquid separation means 20, 22 and 24, with 20 and 22 located in the reaction vessel and 24 external of the vessel, as shown. Each of the two gas-liquid separation means located in the reaction vessel may be a simple horizontal tray containing a plurality of chimneys or hollow tubes extending vertically therethrough, as is well known. Not shown are some of the gas and liquid flow distribution means above each catalyst bed for distributing liquid onto and horizontally across the catalyst bed below. Such means are well known to those skilled in the art and may include, for example, trays such as sieve trays, bubble cap trays, trays with spray nozzles, chimneys or tubes, etc., as is known. The hydrocarbon feed to be hydrotreated is passed via line 28 into vessel 12 above the first liquid stage 16 and down onto and across the catalyst bed below. In this particular illustration of the invention, the feed is a petroleum derived distillate or diesel fuel fraction containing heteroatom compounds of sulfur, nitrogen and perhaps oxygen. Fresh hydrogen or a hydrogen-containing treat gas is passed into the top of vessel 12 above the second stage via lines 30 and 32, with partially hydrotreated first stage liquid effluent recycled via line 34 from the first stage into the top of the reactor via line 32, as part of the second stage feed. The mixture of treat gas and feed passes down through the second liquid stage hydrotreating catalyst bed 14 in which a portion of the hydrogen reacts with the second stage feed to produce a second stage effluent comprising a hydrotreated product liquid and vapor, wherein the vapor comprises a mixture of unreacted hydrogen, some of the lighter or lower boiling feed components, and gaseous reaction products such as methane, $H_2S$ and $NH_3$. Most of the sulfur and other heteroatom compounds are removed from the feed in the first stage. In two stage hydrotreating processes, it is not unusual for 60%, 75% and even ≧90% of the heteroatoms (S, N and 0) to be removed from the liquid in the first stage. Therefore, the second stage catalyst can be a more active, but less sulfur tolerant catalyst for aromatics saturation which, in this embodiment comprises nickel-molybdenum or nickel-tungsten catalytic metal components on an alumina support. The second stage vapor effluent is separated from the hydrotreated second stage product liquid effluent by vapor and liquid separation means 20, with the hydrotreated product liquid removed via line 36 and sent to a product stripper, not shown, to strip out any dissolved $H_2S$ and $NH_3$. The second stage vapor effluent containing unreacted hydrogen passes down through the gas and liquid separator 20 as indicated by the two arrows, into the first liquid reaction stage and down through the first stage catalyst bed 16, where it contacts the incoming feed to be hydrotreated. In the first reaction stage, at least a portion of the unreacted hydrogen in the second stage vapor effluent reacts with the fresh feed containing the sulfur, nitrogen and other undesirable compounds to form a first stage effluent comprising a mixture of partially hydrotreated liquid and a vapor comprising unreacted hydrogen, lighter feed components containing heteroatom compounds, $H_2S$ and $NH_3$. This mixture then passes down to the first stage gas and liquid separation means 22, from which the partially hydrotreated liquid is withdrawn via line 34 and passed, via lines 34 and 32 into the top of the reactor and through the second stage catalyst bed with the treat gas, to form the hydrotreated product liquid. Most (e.g., >50%) of the heteroatom compounds are removed from the feed in the first stage, so that a relatively cleaner feed is recycled back into the second stage. The vapor effluent from the first stage reaction includes unreacted hydrogen, heteroatom-containing hydrocarbon vapors and $H_2S$ and $NH_3$ formed in the first and second stages, and passes down through the third or vapor stage reaction catalyst bed 18, in which at least a portion of the unreacted hydrogen remaining in the vapor reacts with any sulfur and nitrogen compounds in the gaseous feed components to form additional $H_2S$ and $NH_3$. The third stage vapor effluent passes down and out the bottom of the reactor vessel via line 31 and through a heat exchanger 33, in which the hydrotreated hydrocarbons are condensed to liquid, with the mixture of liquid and remaining gas passing into the separator vessel 24 via line 35. Typically the $C_{4+}$–$C_{5+}$ hydrocarbons are condensed to liquid. The hydrotreating catalyst in the first stage must be suitable for processing fresh feed to the reactor which has higher levels of sulfur than the feed to the second stage. The more sulfur resistant catalyst in the first and third stages will typically comprise cobalt and molybdenum metal catalytic components supported on alumina. The gas-liquid separator 24 may be a simple drum separator, with the sulfur and nitrogen reduced liquid removed via line 36 as light product liquid. The final $H_2S$ and $NH_3$ containing gas is removed via line 37 and sent to processing (e.g., scrubbing with an aqueous amine solution) for sulfur and ammonia removal.

The liquid effluent from the first stage which is withdrawn via line 34, will contain small amounts of dissolved $H_2S$ and $NH_3$. This liquid is sent to the second stage which operates in a relatively clean reaction environment (i.e., the feed to the second stage is relatively low in heteroatom impurities relative to the first stage and the fresh hydrogen or hydrogen-containing treat gas to the second stage is essentially free of heteroatom species). In some cases it may be advantageous to further clean the liquid feed (the first stage effluent liquid) to the second stage by removing the relatively small amounts of $H_2S$ and $NH_3$ which may be dissolved in it. A cleaner feed to the second stage will boost the second stage kinetics, particularly if the second stage uses a high performance catalyst which may be sensitive to higher levels of $H_2S$ and $NH_3$. In such cases, at least a portion of the first stage hydrotreated liquid is optionally passed into stripping vessel 26 via lines 34 and 38, in which it flows down and meets an uprising, countercurrent stripping gas such as steam entering via line 40, which strips at least some of the dissolved $H_2S$ and $NH_3$ out of the treated liquid before it enters the second stage. The stripped liquid is removed from the bottom of the vessel via line 42 and passed into the top of the hydrotreating vessel 12, via lines 34 and 32. The stripper contains suitable medium such as packing, mesh, trays or other well known means for increasing the contact area between the stripping gas and the liquid, as is well known. The $H_2S$ and $NH_3$ containing stripping gas exits out of the top of the stripping vessel via line 44 and is sent to further processing. Thus, in this embodiment of the process of the invention, the hydrogen containing treat gas passes down through the reactor vessel 12 once, which eliminates the need for expensive inter-stage compression. With the only inter-stage recycle being the liquid recycle from the first stage reaction zone back up to the second stage, a simple and relatively inexpensive liquid pump (not shown) is all that is needed. The third or vapor stage hydrotreating zone which hydrotreats the sulfur and nitrogen containing vaporized feed components, permits the hydrotreated hydrocarbon vapor components to be condensed to liquid, which may then be blended directly into the final product liquid without further treatment.

Figure 2:
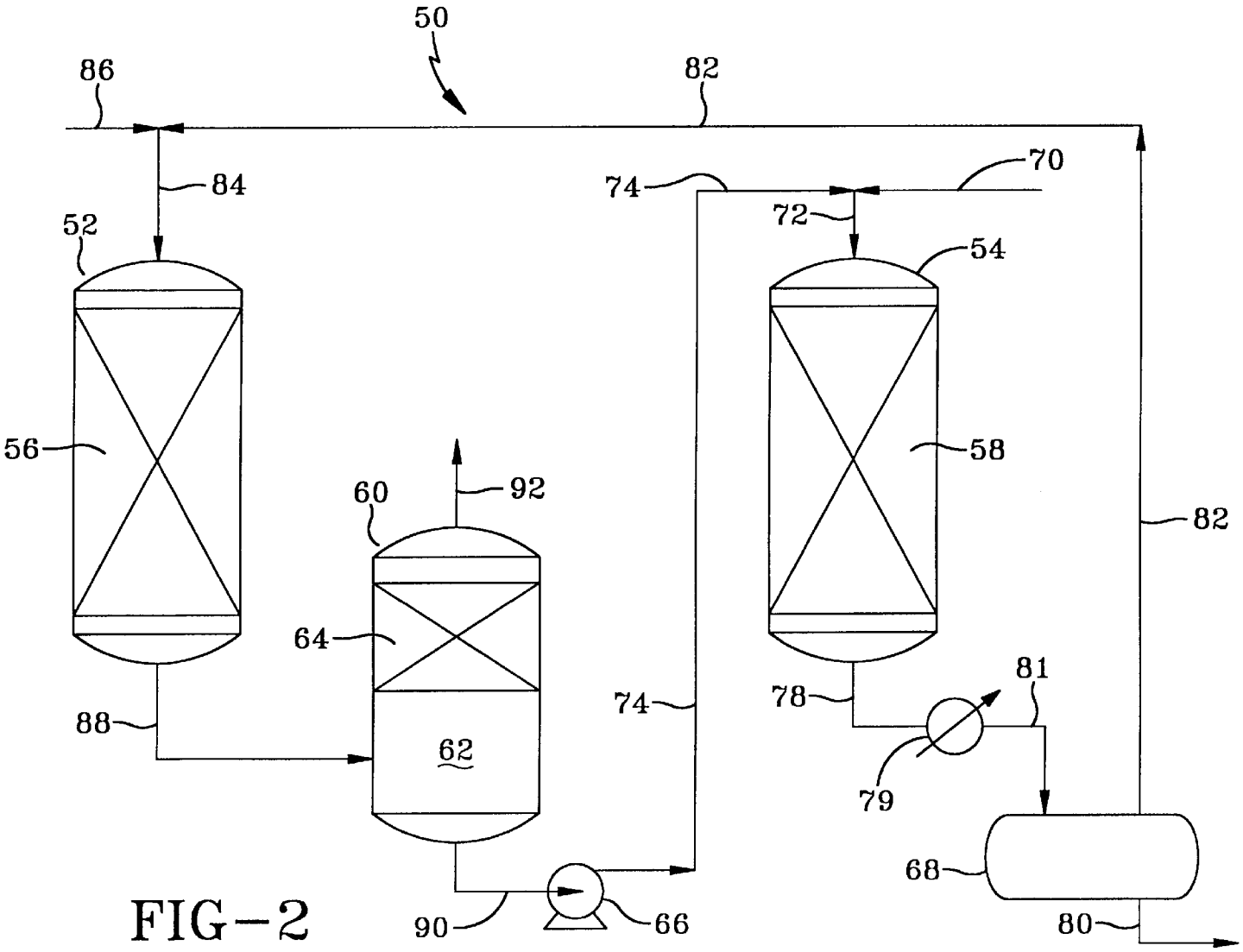
FIG. 2 is a schematic of an embodiment in which each hydroprocessing stage is in a separate vessel.

FIG. 2 is a brief schematic of another embodiment of a process of the invention similar in many respects to that of FIG. 1, but in which the two liquid and one vapor hydrotreating stages or zones are in separate vessels and wherein the first liquid stage gas and liquid separation means is in the bottom of the vessel containing the third or vapor reaction stage. Thus, a hydrotreating unit 50 comprises first and second liquid stage reaction vessels 52 and 54 containing respective fixed catalyst beds 56 and 58 within, for hydrotreating a distillate or diesel feed. A third vessel 60 is a dual function vessel containing a gas/liquid separation zone 62 at the bottom and a vapor stage catalyst bed 64 in its upper portion for removing sulfur and nitrogen from the hydrocarbon vapors present in the vapor effluent from the first stage. Also shown are a liquid circulation pump 66, a heat exchanger 79 and a simple drum separator 68. A treat gas comprising hydrogen enters the second stage reaction vessel 54 via lines 70 and 72 and mixes with partially hydrotreated feed entering via line 74. Most (e.g., >50%) of the feed hydrotreating is accomplished in the first stage hydrotreating vessel 52. The second stage is at a higher pressure than the first stage and most of the sulfur and nitrogen compounds have been removed from the feed in the first stage, so that a more active, and less sulfur tolerant, higher pressure hydrotreating catalyst can be used in the second stage. The liquid and treat gas pass down through the catalyst bed and the hydrogen reacts with the feed to remove sulfur and nitrogen compounds to form $H_2S$ and $NH_3$, with the hydrotreated product liquid and the vapor effluent from the second stage passing out through the bottom of the vessel via line 78, heat exchanger 79 and line 81, and into drum separator 68 in which the gas and liquid phases are separated. The heat exchanger 79 is optional and may be used to cool the mixed effluent down to a temperature sufficient to condense the heavier (e.g., $C_{4+}$–$C_{5+}$) hydrotreated hydrocarbon vapors, if desired. If necessary and if desired, the reaction conditions are sufficiently severe to saturate aromatics present in the feed. The hydrotreated product liquid is removed from the separator via line 80. The vapor phase, containing vaporized hydrocarbons, unreacted hydrogen, gas reaction products, $H_2S$ and $NH_3$ is removed via line 82 and passed into line 84 where it mixes with the fresh incoming feed from line 86. The feed and vapor mixture passes down into vessel 52 and cocurrently down through the catalyst bed which contains a more sulfur tolerant catalyst as in the embodiment above in FIG. 1, in which the hydrogen reacts with the feed to remove sulfur and nitrogen compounds as $H_2S$ and $NH_3$ and also saturate olefins and aromatics, to form a partially hydrotreated liquid and a vapor containing vaporized feed components, some unreacted hydrogen, $H_2S$ and $NH_3$. The vapor and liquid effluent from the first stage is removed from the bottom of the vessel via line 88 and passed into the gas and liquid separation zone 62 in vessel 60. The liquid is removed from the bottom of 60 via line 90 and passed up into the top of the second stage reactor vessel 54, via pump 66, line 74 and line 72. The vapor phase passes up into hydrotreating catalyst bed 64 in which the remaining sulfur and nitrogen compounds are removed from the vaporized feed components by reacting with the hydrogen in the gas to convert any remaining sulfur and nitrogen compounds into $H_2S$ and $NH_3$ which are removed from the top of the vessel via line 92, along with the hydrotreated hydrocarbon vapor components. This hydrotreated gas is then passed via line 92 through a heat exchanger and knock-out or separation drum (not shown) as in FIG. 1, and the recovered hydrotreated lighter hydrocarbon liquid optionally blended with the heavier hydrotreated product liquid recovered via line 80.

Figure 3:
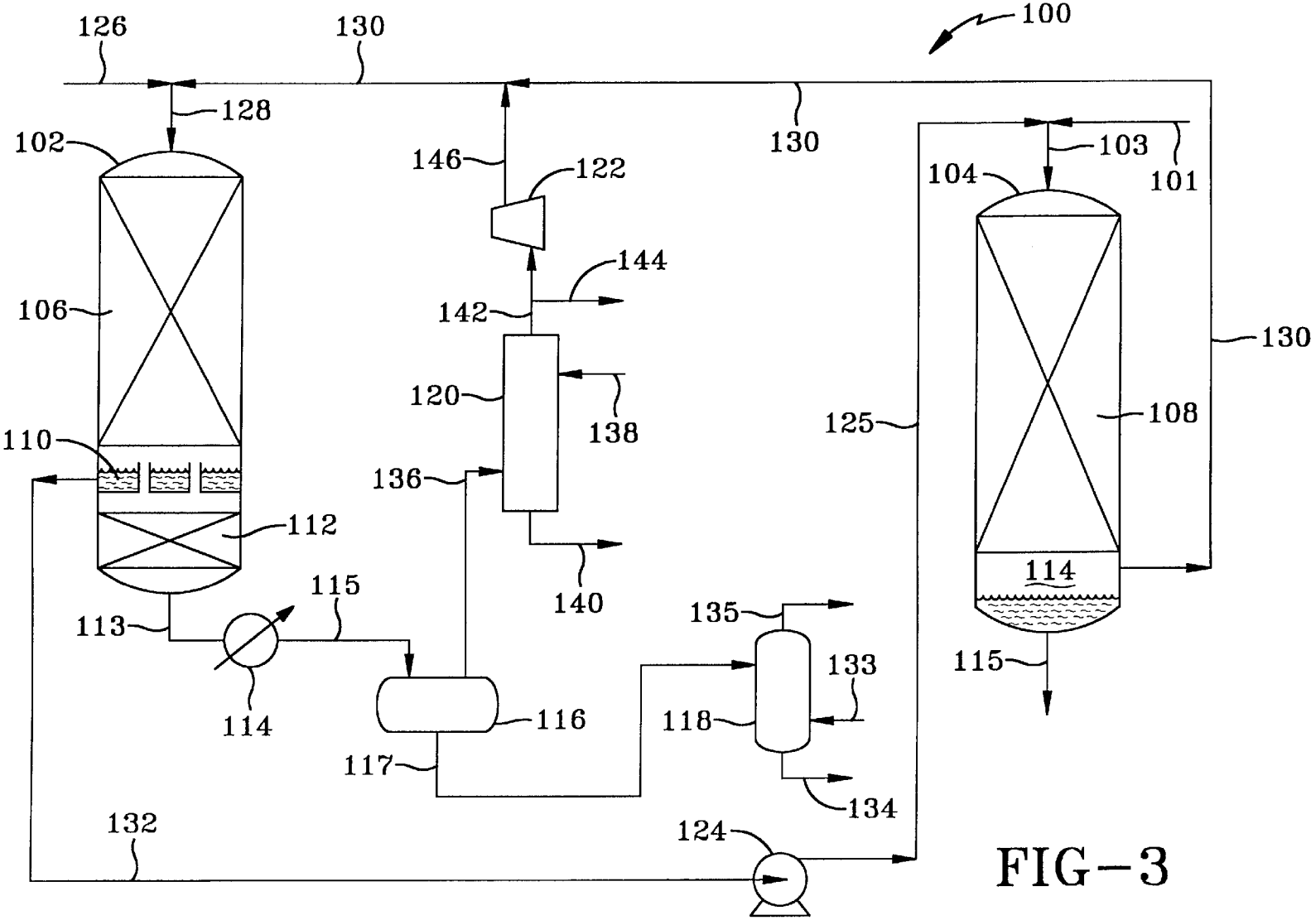
FIG. 3 is a schematic flow diagram in which the three hydroprocessing stages are in two separate vessels with gas cleanup and recycle.

FIG. 3 is a schematic illustrating yet another embodiment of the process of the invention which, as with the illustrations above, will be explained with specific reference to hydrotreating a petroleum derived distillate or diesel fuel for simplicity. Thus, in FIG. 3 a hydrotreating unit 100 is shown which comprises first and second liquid stage reaction vessels 102 and 104 containing respective fixed catalyst beds 106 and 108 within, for hydrotreating a raw distillate or diesel fuel feed. Also shown are a heat exchanger 114, gas and liquid separator 116, product stripper 118, gas scrubber 120, gas compressor 122 and liquid transfer pump 124. Below the fixed bed of hydrotreating catalyst 106 in the first reaction stage vessel 102 is a gas and liquid separating means 110, followed by another fixed bed of hydrotreating catalyst 112 which comprises a vapor reaction stage for hydrotreating fractions of the liquid feed which have been vaporized to form part of the vapor stream during the reactions. Instead of a separate separator, the gas and liquid separating means for the second stage reaction effluent is the space 114 at the bottom of the reactor 104 under the catalyst bed 108. Alternately, a separator vessel could be used to separate the second stage vapor and liquid effluents. In operation, fresh feed is passed into 102 via lines 126 and 128, along with hydrogen-containing second stage vapor effluent from line 130 recovered from the second stage reactor, as shown. The fresh feed and vapor pass cocurrently down through the first stage catalyst bed in which the hydrogen reacts with the heteroatom compounds and unsaturates to remove most (e.g., >50%) of the sulfur and nitrogen compounds as $H_2S$ and $NH_3$, and saturate at least a portion of the aromatics. The first stage reaction effluent comprises a mixture of partially hydrotreated liquid and vapor. The vapor contains unreacted hydrogen, along with $H_2S$, $NH_3$, and hydrocarbon vapors. This vapor passes down into the gas and liquid separator 110 to separate the liquid from the vapor. The partially hydrotreated liquid is removed from the separator via line 132 and passed to liquid transfer pump 124. The hydrogen containing first stage vapor effluent passes from the gas and liquid separator 110, down through vapor hydrotreating catalyst bed 112, in which the vaporized feed components are hydrotreated with the unreacted hydrogen in the vapor to further remove sulfur and nitrogen to form hydrotreated hydrocarbons and additional $H_2S$ and $NH_3$. The hydrotreated vapor is removed from the bottom of vessel 102 via line 113 and then passed through a heat exchanger 114 in which it is cooled to condense some of the hydrocarbons (e.g., $C_{4+}$–$C_{5+}$) to liquid. The resulting gas and liquid mixture is passed into gas and liquid separating drum 116 via line 115 in which the gas is separated from the condensed hydrocarbon liquid. The hydrocarbon liquid is removed from the separator via line 117 and passed into a stripper 118 in which the downflowing liquid is stripped by an upflowing stripping gas such as steam or nitrogen entering via line 133. The stripping gas removes $H_2S$ and $NH_3$ dissolved in the gas, with the heteroatom laden gas removed via line 135 from the top of the stripper and the stripped liquid removed from the bottom via line 134. The stripped hydrocarbon liquid may then be combined with the second stage stripped (not shown) product liquid. The gas phase is removed from separator 116 via line 136 and passed into the bottom of a scrubbing tower 120, in which the uprising gas contacts a downflowing, aqueous amine solution entering near the top of the tower via line 138. The amine solution removes the $H_2S$ and $NH_3$ from the gas and passes out of the bottom of the tower via line 140 and sent to further processing. The cleaned gas, substantially reduced in $H_2S$ and $NH_3$, contains valuable and usable hydrogen, and passes out of the top of the tower via line 142 and is passed into compressor 122 which raises the gas pressure high enough for it to be recycled back into the first stage via lines 146, 130 and 128 as treat gas. Purge line 144 prevents excess methane and other diluents from building up in the process. The mostly hydrotreated hydrocarbon liquid is pumped into the top of the second stage reactor via lines 125 and 103. Fresh hydrogen or a hydrogen-containing treat gas is also fed into the top of the second stage reactor via lines 101 and 103. The hydrocarbon liquid and fresh treat gas pass cocurrently down through second stage hydrotreating catalyst bed 108 in which the hydrogen reacts with and hydrotreats the hydrocarbon liquid to convert most of the remaining heteroatom compounds to $H_2S$ and $NH_3$ and saturate any remaining unsaturates to produce a hydrotreated product liquid which, in this example, is a light distillate or diesel fuel fraction. The vapor and liquid effluent from the second stage catalyst bed pass down into the bottom 114 of the reactor in which the vapor separates from the liquid. The liquid is removed from the bottom as hydrotreated product via line 15 and sent to product stripping (not shown) to strip out dissolved $H_2S$ and $NH_3$. The hydrogen containing vapor effluent is removed from the reactor via line 130 and passed back into the top of the first stage reactor to provide at least a portion of the hydrogen for the first stage hydrotreating. This hydrogen containing vapor effluent in line 130 may also be cooled down to condense out some of the vaporized hydrocarbons in the second stage vapor effluent. As is the case for the embodiments illustrated above in FIGS. 1 and 2, the pressure in the second stage reactor in this embodiment is sufficiently higher than that in the first stage reactor to avoid the need for a compressor to pass the gas from the second to first stage. In all cases, and as illustrated in FIG. 3, recycle gas cleanup can be integrated into the hydroprocessing process if desired or if necessary. In a still further embodiment of the process of the invention, $H_2S$ and $NH_3$ can be scrubbed out of the vapor stage reaction gas effluent and recycled as part of the feed to the second stage liquid reaction zone, instead of to the first stage liquid reaction zone. This option applies to all of the embodiments described herein.

Those skilled in the art will appreciate that the invention can be extended to more than two liquid and one vapor stages. Thus, one may also employ three or more liquid stages in which the partially processed liquid effluent from the first stage is the second stage feed, the second stage liquid effluent is the third stage feed, and so on, with attendant vapor stage processing in one or more vapor reaction stages. By reaction stage is meant at least one catalytic reaction zone in which the liquid, vapor or mixture thereof reacts with hydrogen in the presence of a suitable hydroprocessing catalyst to produce an at least partially hydroprocessed effluent. The catalyst in a reaction zone can be in the form of a fixed bed, a fluidized bed or dispersed in a slurry liquid. More than one catalyst can also be employed in a particular zone as a mixture or in the form of layers (for a fixed bed). Further, where fixed beds are employed, more than one bed of the same or different catalyst may be used, so that there will be more than one reaction zone. The beds may be spaced apart with optional gas and liquid distribution means upstream of each bed, or one bed of two or more separate catalysts may be used in which each catalyst is in the form of a layer, with little or no spacing between the layers. The hydrogen and liquid will pass successively from zone to the next. The hydrocarbonaceous material and hydrogen or treat gas are introduced at the same or opposite ends of the stage and the liquid and/or vapor effluent removed from a respective end.

The term "hydrotreating" as used herein refers to processes wherein a hydrogen-containing treat gas is used in the presence of a suitable catalyst which is primarily active for the removal of heteroatoms, such as sulfur, and nitrogen, nonaromatics saturation and, optionally, saturation of aromatics. Suitable hydrotreating catalysts for use in a hydrotreating embodiment of the invention include any conventional hydrotreating catalyst. Examples include catalysts comprising of at least one Group VIII metal catalytic component, preferably Fe, Co and Ni, more preferably Co and/or Ni, and most preferably Co; and at least one Group VI metal catalytic component, preferably Mo and W, more preferably Mo, on a high surface area support material, such as alumina. Other suitable hydrotreating catalysts include zeolitic catalysts, as well as noble metal catalysts where the noble metal is selected from Pd and Pt. As mentioned above, it is within the scope of the present invention that more than one type of hydrotreating catalyst may be used in the same reaction stage or zone. Typical hydrotreating temperatures range from about 100° C. to about 400° C. with pressures from about 50 psig to about 3,000 psig, preferably from about 50 psig to about 2,500 psig. If one of the reaction stages is a hydrocracking stage, the catalyst can be any suitable conventional hydrocracking catalyst run at typical hydrocracking conditions. Typical hydrocracking catalysts are described in U.S. Pat. No. 4,921,595 to UOP, which is incorporated herein by reference. Such catalysts are typically comprised of a Group VIII metal hydrogenating component on a zeolite cracking base. Hydrocracking conditions include temperatures from about 200° to 425° C.; a pressure of about 200 psig to about 3,000 psig; and liquid hourly space velocity from about 0.5 to 10 V/V/Hr, preferably from about 1 to 5 V/V/Hr. Non-limiting examples of aromatic hydrogenation catalysts include nickel, cobalt-molybdenum, nickel-molybdenum, and nickel-tungsten. Noble metal (e.g., platinum and/or palladium) containing catalysts can also be used. The aromatic saturation zone is preferably operated at a temperature from about 40° C. to about 400° C., more preferably from about 260° C. to about 350° C., at a pressure from about 100 psig to about 3,000 psig, preferably from about 200 psig to about 1,200 psig, and at a liquid hourly space velocity (LHSV) of from about 0.3 V/V/Hr. to about 2 V/V/Hr.

It is understood that various other embodiments and modifications in the practice of the invention will be apparent to, and can be readily made by, those skilled in the art without departing from the scope and spirit of the invention described above. Accordingly, it is not intended that the scope of the claims appended hereto be limited to the exact description set forth above, but rather that the claims be construed as encompassing all of the features of patentable novelty which reside in the present invention, including all the features and embodiments which would be treated as equivalents thereof by those skilled in the art to which the invention pertains.

What is claimed is:

1. A hydroprocessing process which includes two liquid and one vapor reaction stages all in a single reaction vessel and which comprises the steps of:

(a) reacting a hydrocarbonaceous feed comprising a mixture of liquid and vapor with hydrogen in a first hydroprocessing liquid reaction stage in the presence of a hydroprocessing catalyst to form a first stage effluent comprising a partially hydroprocessed hydrocarbonaceous liquid and a hydrocarbonaceous vapor which contains unreacted hydrogen, wherein said feed vapor comprises a second stage hydrocarbonaceous vapor effluent which contains unreacted hydrogen in an amount sufficient to provide at least a portion of said hydrogen for said first reaction stage and for said vapor reaction stage;

(b) separating said first stage liquid and vapor effluents;

(c) reacting said first stage liquid effluent with hydrogen in the presence of a hydroprocessing catalyst in said second hydroprocessing liquid reaction stage to produce a second stage effluent comprising a hydroprocessed hydrocarbonaceous product liquid and a hydrocarbonaceous vapor, said vapor containing unreacted hydrogen, and wherein said second stage reaction hydrogen is provided by fresh hydrogen or a hydrogen-containing treat gas;

(d) separating said second stage liquid and vapor effluents and recovering said hydroprocessed product liquid;

(e) passing said separated second stage vapor effluent into said first stage;

(f) passing said separated, hydrogen-containing first stage vapor effluent into said vapor hydroprocessing stage, and (g) reacting said first stage hydrocarbonaceous vapor effluent with hydrogen in said vapor in the presence of a hydroprocessing catalyst in said vapor reaction stage to form a hydroprocessed hydrocarbonaceous vapor, wherein at least a portion of said hydrogen for said reaction is provided by said unreacted hydrogen in said first stage vapor effluent.

2. A process according to claim 1 wherein at least a portion of said hydroprocessed hydrocarbonaceous vapor is condensed to liquid.

3. A process according to claim 2 wherein at least a portion of said condensed hydrocarbonaceous vapor is blended with said hydroprocessed product liquid.

4. A process according to claim 2 wherein said condensed vapor comprises a $C_{4+}$–$C_{5+}$hydrocarbonaceous liquid.

5. A process according to claim 1 wherein at least a portion of said first liquid stage reaction hydrogen comprises fresh hydrogen or a hydrogen-containing treat gas.

6. A process according to claim 1 wherein at least a portion of said vapor stage reaction hydrogen comprises fresh hydrogen or a hydrogen-containing treat gas.

7. A process according to claim 6 wherein all of said first liquid stage reaction hydrogen is provided by said second stage vapor effluent.

8. A process according to claim 1 wherein said reaction hydrogen for all three stages is provided by said second liquid stage fresh hydrogen or hydrogen-containing treat gas.

9. A process according to claim 1 wherein said second liquid stage is operated at a pressure higher than said first liquid stage.

10. A process according to claim 1 wherein said second stage vapor effluent is cooled to condense a portion of said vapor as liquid which is separated from the remaining vapor, with the remaining, hydrogen-containing vapor then passed into said first liquid stage to provide at least a portion of said reaction hydrogen for said first stage.

11. A process according to claim 1 wherein said hydrocarbonaceous feed comprises a hydrocarbon liquid.

12. A process according to claim 1 wherein said fresh hydrogen or hydrogen treat gas and said hydrocarbonaceous liquid pass cocurrently through said second stage.

13. A process for hydrotreating a feed comprising a hydrocarbon liquid which contains heteroatom compounds and unsaturates in two liquid and one vapor reaction stages, all of which are in the same vessel, which comprises the steps of:

(a) reacting said feed with hydrogen in a first hydrotreating liquid reaction stage, in the presence of a hydrotreating catalyst and a hydrogen-containing second liquid stage vapor effluent, to remove most of said heteroatom compounds and unsaturates from said feed to form a first stage effluent comprising a partially hydrotreated liquid and a hydrocarbon vapor which contains unreacted hydrogen, wherein said second stage vapor effluent provides at least a portion of the hydrogen for said first stage reaction and wherein said first stage vapor effluent contains unreacted hydrogen;

(b) separating said first stage liquid and vapor effluent;

(c) reacting said first stage liquid effluent with hydrogen in the presence of a hydrotreating catalyst in a second hydrotreating liquid reaction stage to remove additional heteroatom compounds and unsaturates to produce a second stage effluent comprising a hydrotreated hydrocarbon product liquid and a hydrocarbon vapor, said vapor containing unreacted hydrogen, and wherein said second stage reaction hydrogen is provided by fresh hydrogen or a hydrogen-containing treat gas;

(d) separating said second stage liquid and vapor effluent and recovering said hydrotreated product liquid;

(e) passing said separated second stage vapor effluent into said first stage;

(f) passing said separated, hydrogen-containing first stage vapor effluent into said vapor hydrotreating stage, and (g) reacting said hydrogen-containing first stage vapor effluent with hydrogen in the presence of a hydrotreating catalyst in said vapor reaction stage to form a hydrotreated hydrocarbon vapor, wherein at least a portion of said hydrogen for said reaction is provided by said hydrogen in said first stage vapor effluent.

14. A process according to claim 13 wherein at least a portion of said hydrotreated hydrocarbon vapor is condensed to liquid.

15. A process according to claim 14 wherein at least a portion of said condensed hydrocarbon vapor is blended with said hydrotreated product liquid.

16. A process according to claim 14 wherein said condensed vapor comprises a $C_{4+}$–$C_{5+}$hydrocarbon liquid.

17. A process according to claim 13 wherein said second stage vapor effluent is cooled to condense a portion of said vapor as liquid which is separated from the remaining vapor, with the remaining, hydrogen-containing vapor then passed into said first liquid stage to provide at least a portion of said reaction hydrogen for said first stage.

18. A process according to claim 13 wherein at least a portion of said first liquid stage reaction hydrogen comprises fresh hydrogen or a hydrogen-containing treat gas.

19. A process according to claim 13 wherein at least a portion of said vapor stage reaction hydrogen comprises fresh hydrogen or a hydrogen-containing treat gas.

20. A process according to claim 13 wherein said reaction hydrogen for all three stages is provided by said fresh hydrogen or hydrogen-containing treat gas introduced into said second liquid stage.

21. A process according to claim 13 wherein said second liquid stage is operated at a pressure higher than said first liquid stage.

22. A process according to claim 13 wherein said fresh hydrogen or hydrogen treat gas and said hydrocarbon liquid pass cocurrently through said second stage.

* * * * *